United States Patent [19]

Le Huédé et al.

[11] 4,134,287

[45] Jan. 16, 1979

[54] METHOD FOR MECHANICAL REMOVAL OF TENSILE STRESSES IN A TUBE WHICH HAS BEEN EXPANDED IN A SUPPORT

[75] Inventors: Georges Le Huédé, Champagne sur Seine; Guy Zacharie, Fontainebleau, both of France

[73] Assignee: Electricite de France, Paris, France

[21] Appl. No.: 808,563

[22] Filed: Jun. 21, 1977

[30] Foreign Application Priority Data

May 2, 1977 [FR] France ..... 77 13196

[51] Int. Cl.[2] ..... B21D 39/08

[52] U.S. Cl. ..... 72/370; 29/157.4

[58] Field of Search ..... 72/370; 29/157.4, 157.5, 29/523

[56] References Cited

U.S. PATENT DOCUMENTS

| | | | |
|---|---|---|---|
| 1,647,447 | 11/1927 | Hartnett | 72/370 |
| 1,951,833 | 3/1934 | Maupin | 29/157.5 |
| 3,956,818 | 5/1976 | Hauschke et al. | 29/523 |
| 3,978,810 | 9/1976 | Krips et al. | 29/157.4 |

*Primary Examiner*—Lowell A. Larson

*Attorney, Agent, or Firm*—Thomas R. Boland

[57] ABSTRACT

A tube which has been expanded in a support such as the tube-sheet of a heat exchanger is subjected to diametral deformation of controlled intensity and direction in the transition zone between the expanded portion of the tube and the portion which has a nominal diameter by means of an axially displaceable and radially expandable tool having a bullet-nosed shape or by means of a tube-expander of the type comprising a mandrel fitted with rollers or by means of a fluid under pressure.

6 Claims, 3 Drawing Figures

METHOD FOR MECHANICAL REMOVAL OF TENSILE STRESSES IN A TUBE WHICH HAS BEEN EXPANDED IN A SUPPORT

This invention relates to a method for ensuring relaxation of residual stresses in a tube which is fixed on a support by the tube-expansion process, in the zone of transition between the expanded portion and the non-deformed portion of said tube.

It is a very common practice in the technique to adopt the method of mechanical expansion of tubes in a support, especially in a plate provided with bores in which tubes are intended to be fitted such as, for example, the tube-sheet of a heat exchanger. In a first stage, this method consists in enlarging each tube from the interior in order to bring it into contact with the surface of the corresponding bore. A second stage of the method consists in forcibly applying the tube against said wall and carrying out a veritable cold-rolling or cold-forging operation on the metal of the tube which is thus caused to adhere to the plate. The materials of the tube and of the plate are chosen so as to ensure that their mechanical characteristics result in plastic deformation of the tube without exceeding the elastic limit of the plate. If necessary, the tube-expansion process can be completed by an end-welding operation.

Expansion of tubes is carried out in a conventional manner by means of suitable tools known as tube-expanders and usually provided with a series of rollers having axes either parallel or inclined to the axis of the bore and of the tube which is engaged in this latter. The rollers are driven in rotation and forced outwards by an axial mandrel which is displaced between said rollers and these latter accordingly thrust the wall of the tube against the wall of the bore.

At the point located between the expanded portion proper which has a larger diameter and that portion of the tube which has the initial nominal diameter, the tube is subject to appreciable residual tensile stresses which are liable to result in crack formation in a corrosive medium and in some cases in piercing of tubes during operation. It therefore appears essential, especially in a heat exchanger, to carry out preliminary removal of tensile stresses from the regions mentioned above prior to utilization of the tubes in order to obtain practically total relaxation of these residual stresses which have an adverse effect on the subsequent good resistance of these tubes.

Various methods of stress removal have already been contemplated and consist more especially of a heat treatment of the zones concerned. In order to ensure correct execution, however, the operation gives rise to difficulties by reason of the fact that heating has to be limited to the zone or region of transition between the expanded portion and non-deformed portion of each tube in order to prevent simultaneous relaxation of the stresses which ensure mechanical resistance for the tube-expansion process itself, especially if the coefficient of expansion of the tubes is higher than that of the plate. Moreover, when the tube has higher creep strength than the plate, for example when said tube is formed of austenitic stainless steel or of an alloy having a high nickel content and when the plate is of carbon steel, for example, the thermal cycle which is applied and limited in temperature in order to ensure that the characteristics of the plate are not impaired results in only slight reduction of stresses beyond the expanded zone.

By reason of the difficulties mentioned in the foregoing, no consideration has been given to large-scale industrial application of any of these methods and the removal of tensile stresses in the transition zones has consequently been abandoned in the majority of instances.

The present invention relates to a method of mechanical removal of tensile stresses especially in the transition zone of a tube which has been expanded in a support. This method can be carried into effect on completion of the tube-expansion process, namely after the connection between the tube and the support has been completed.

To this end, the method under consideration consists in subjecting the expanded tube to diametral deformation of controlled intensity and direction in the zone of transition between the expanded portion of said tube and that portion which has a nominal diameter.

This method is based on a known general principle which consists in removing the residual stresses of a treated part by subjecting this latter to mechanical deformation in such a manner as to attain the elastic limit of the part as a whole. The zones in which residual stresses exist then undergo plastic deformation whilst the zones in which such stresses do not exist undergo deformation to a lesser degree. This accordingly results in adaptation of the different zones of the part and in a considerable reduction of local residual stresses only after relaxation has taken place, that is to say when the part has practically been restored to its initial shape. By way of indication, a process of this type for the mechanical removal of tensile stresses is commonly applied to straight portions of tubes after straightening by producing a tractive force which causes the tube to undergo slight elongation at the end of the manufacturing process. However, this method does not lend itself to the particular application which is more especially contemplated, namely the application which consists in expanding tubes in a support and especially in a plate.

The method in accordance with the present invention is based on a different application of the same principle in which it is sought to carry out controlled diametral deformation of the zones concerned.

In a first embodiment of the method, diametral deformation of the tube is carried out by controlling the axial forward motion of a tool having a conical or bullet-nosed shape by means of a jack or the like. In an alternative embodiment, a tool which is capable of radial outward expansion can be employed with a view to producing the same effect.

In accordance with yet another alternative embodiment, diametral deformation of the tube is carried out by means of a tube-expander fitted with rotating rollers. Finally, in yet another alternative embodiment, diametral deformation of the tube is carried out by introducing a fluid under pressure into the interior of said tube.

Further distinctive features of the method in accordance with the invention for mechanical removal of tensile stresses from a tube after expansion of said tube in a support will become apparent from the following description of a number of exemplified embodiments which are given by way of indication without any limitation being implied, reference being made to the accompanying drawings, wherein.

Figure 1:
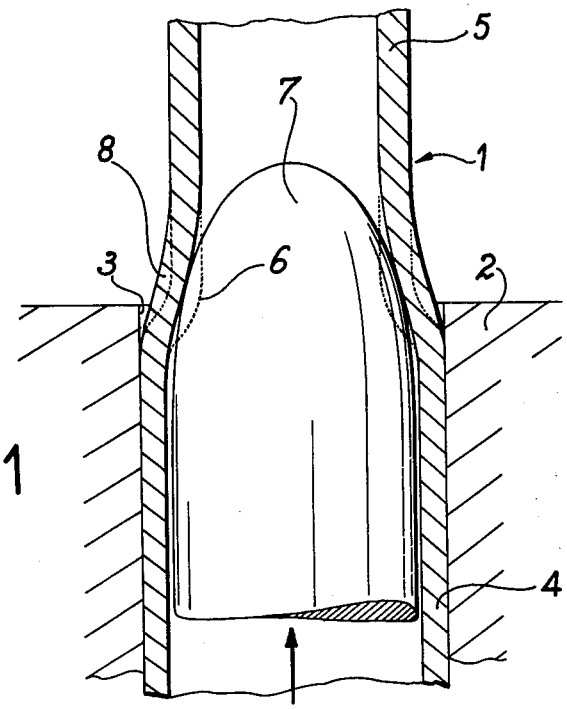
FIGS. 1 and 2 are diagrammatic longitudinal part-sectional views of a tube which has been expanded in a plate and of a tool which has been engaged within the interior of said tube so as to permit relaxation of stresses in the zone of transition between the expanded portion and the external portion of said tube which has a nominal diameter.

In FIG. 1, the reference 1 designates the end of a cylindrical metallic tube, said tube being fixed in a transverse plate 2 which is also metallic by means of a conventional method of tube-expansion. To this end, the plate 2 has a bore 3, the dimensions of which permit engagement of the tube 1. The portion 4 of said tube which is located within the bore is forcibly applied against the internal wall of said bore by any suitable means such as a tube-expander having an axial mandrel (not shown in the drawings), thereby securing the tube by expansion and adhesion of this latter. The portion 4 which has thus been expanded is joined to the nominal-diameter portion 5 of the tube located externally of the bore 3 by means of a transition zone 6 as shown in dotted lines in the drawing.

In accordance with the invention, the removal of residual stresses produced by tube-expansion in the transition zone 6 is carried out by engagement of a tool 7 of conical or bullet-nosed shape within the interior of the tube and beyond the expanded portion 4, the tool being progressively displaced in forward motion and in the axial direction, especially by means of a pneumatic or hydraulic jack. The transition zone 6 can accordingly be subjected to outward deformation and thus brought at the end of travel to the position 8 which is illustrated in full lines in the figure. By way of indication, the deformation to be applied to the transition zone is usually of the order of 0.5 % on the diameter and can be obtained automatically, for example by controlling the amplitude of displacement of the tool 7.

Figure 2:
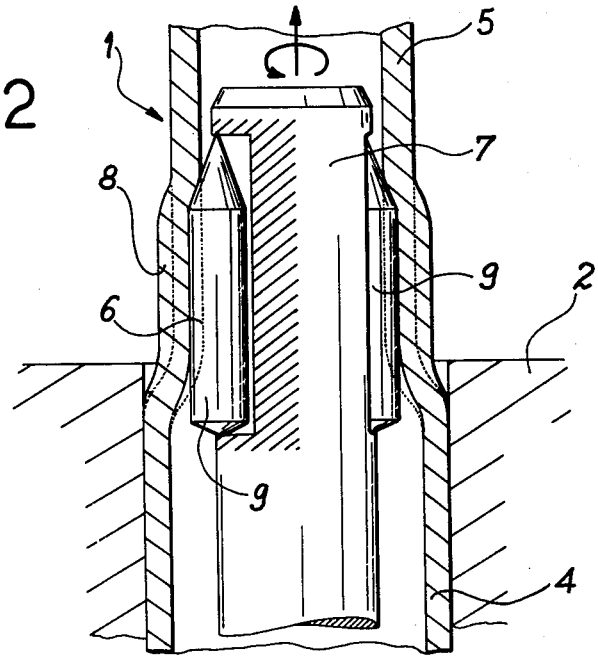

The alternative embodiment which is illustrated in FIG. 2 consists in making use of the tool 7 (of the tube-expander type) for causing deformation of the transition zone 6 of the expanded tube by means of an axial mandrel which carries rotating rollers 9. In this case also, stress relaxation resulting from outward deformation of the transition zone 6 can readily be adjusted by programming the stoppage of the mandrel which carries the rollers after these latter have carried out a suitable number of revolutions corresponding to a predetermined deformation as defined by preliminary calibration.

Figure 3:
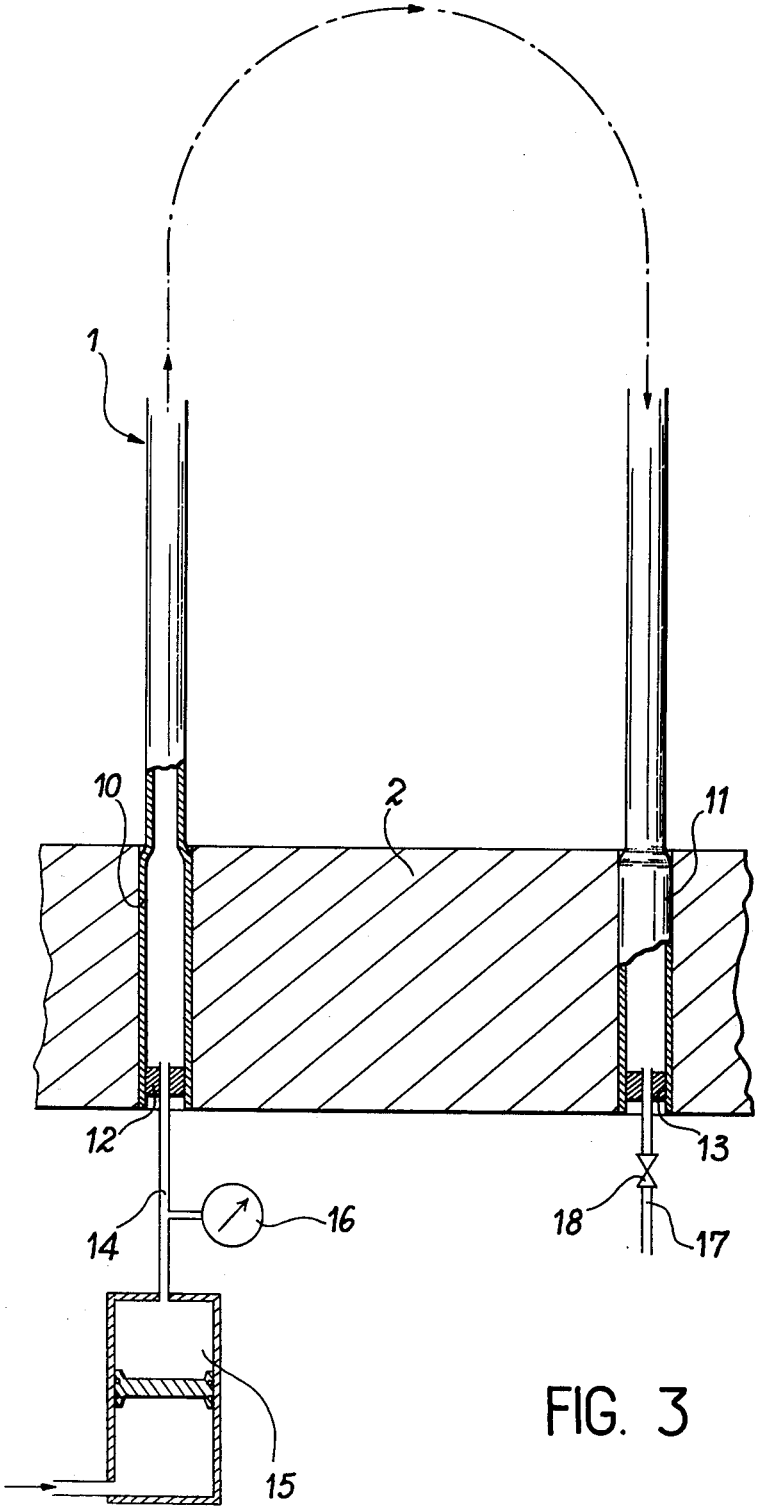
FIG. 3 is a view to a smaller scale which illustrates an alternative form of construction of an installation for the practical application of said method.

In a further alternative embodiment of the method according to the invention which is illustrated in FIG. 3, the deformation of the transition zones of the tube 1 after expansion of its end portions 10 and 11 is carried out by subjecting said tube to hydraulic pressure. The expanded end portions are accordingly closed-off by means of two removable seals 12 and 13 respectively. The seal 12 is traversed by a pipe 14 which connects the interior of the tube to a hydraulic pump 15 or the like, the pressure being measured within said pipe 14 by means of a pressure gage 16. Similarly, the seal 13 is connected by means of a pipe 17 to an outlet and drainage valve 18.

In this alternative embodiment, the pressure developed by the hydraulic pump 15 within the tube 1 is chosen so as to produce sufficient deformation of the transition zones of the tube beyond the expanded portions by inducing a mean circumferential stress which attains a predetermined value. However, it should be noted that, in order to calculate the minimum pressure which is necessary for removal of tensile stress in all the tubes of a given stock, the situation which is liable to arise from the substantial dispersions in the mechanical and geometrical characteristics of these tubes is such that the pressure which is necessary for removal of tensile stresses in the tube of highest strength results in excessive deformation of the tube of lowest strength. It can therefore prove harmful to apply a single internal pressure to all the tubes in order to obtain removal of tensile stresses in the transition zones.

Advantageously, the process employed is suitably modified in order to subject the tubes to a variation in volume which is identical in the case of all the tubes, which in fact consists in imposing a deformation instead of a stress.

The relation between the variation in internal volume $\Delta V$ of the tube and the variation in diameter $\Delta\phi$ of the tube is given by the formula:

$$\Delta V = (\pi/2)\, L\, \phi_i^2\, (\Delta\phi/\phi_i) \qquad (1)$$

where L is the length of the tube and $\phi_i$ is the mean internal diameter. This volume $\Delta V$ is also the volume of the fluid to be injected after filling of the tube when the operation is carried out with an incompressible fluid.

The relation (1) given above has an advantage in that it does not involve the thickness of the tubes. Moreover, in the case of a given stock of tubes, the variations in internal diameter are usually small, namely of the order of plus or minus 2%. In consequence, the variation in volume $\Delta V$ which is necessary in order to obtain a given deformation $\Delta\phi/\phi_i$ will vary from one tube to another only if the length L varies. In particular, in the case of heat exchangers in which the tube lengths do not vary over an unduly wide range, the variation in volume $\Delta V$ which is necessary for removal of tensile stress will be practically always the same.

In consequence, the mechanical removal of tensile stresses in tubes which have been expanded in a support and especially in a plate can therefore be carried out in a simple and convenient manner by means of the method in accordance with the invention. It is thus possible to achieve a considerable improvement in the mechanical characteristics of these tubes with respect to corrosion under tension as a result of relaxation of stresses which would otherwise be liable to cause irremediable formation of cracks in certain media.

We claim:

1. A method for the mechanical removal of tensile stresses in a tube including a radially expanded portion, a non-expanded portion, and a transition zone between said expanded and non-expanded portions, comprising contacting said transition zone with expansion means and effecting a diametral deformation of controlled intensity and direction in said transition zone.

2. A method according to claim 1, wherein diametral deformation of the tube is carried out by controlling the axial forward motion of a tool having a conical or bullet-nosed shape by means of a jack or the like.

3. A method according to claim 1, wherein diametral deformation of the tube is carried out by means of a tool which is capable of radial outward expansion.

4. A method according to claim 1, wherein diametral deformation of the tube is carried out by means of a tube-expander fitted with rotating rollers.

5. A method according to claim 1, wherein diametral deformation of the tube is carried out by introducing a fluid under pressure into the interior of said tube.

6. A tube which is expanded in a support and in which tensile stresses are removed by means of the method according to claim 1.

* * * * *